US009941630B2

(12) United States Patent
Sato

(10) Patent No.: US 9,941,630 B2
(45) Date of Patent: Apr. 10, 2018

(54) POWER SOURCE CONNECTOR DEVICE

(71) Applicant: HIROSE ELECTRIC CO., LTD., Tokyo (JP)

(72) Inventor: Seitaro Sato, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/467,163

(22) Filed: Mar. 23, 2017

(65) Prior Publication Data

US 2017/0288339 A1 Oct. 5, 2017

(30) Foreign Application Priority Data

Apr. 4, 2016 (JP) ..... 2016-075172

(51) Int. Cl.
*H01R 13/627* (2006.01)
*H01R 13/629* (2006.01)
*H01R 12/77* (2011.01)

(52) U.S. Cl.
CPC ..... *H01R 13/629* (2013.01); *H01R 12/777* (2013.01)

(58) Field of Classification Search
CPC ..... H01R 13/6275; H01R 13/6272; H01R 13/641; H01R 13/111
USPC ..... 439/358, 357, 352–354, 489, 948
See application file for complete search history.

(56) References Cited

U.S. PATENT DOCUMENTS 7,431,605 B2 * 10/2008 Dieterle ..... H01R 13/6272 439/358
9,300,088 B2 * 3/2016 Tseng ..... H01R 13/64
2006/0094306 A1 5/2006 Masaki
2010/0267269 A1 10/2010 Umehara et al.
2015/0056869 A1 2/2015 Yoshida

FOREIGN PATENT DOCUMENTS

EP 2242148 A1 10/2010
JP 2009-004247 A 1/2009

* cited by examiner

*Primary Examiner* — Phuong Chi T Nguyen
(74) *Attorney, Agent, or Firm* — Kubotera & Associates, LLC

(57) ABSTRACT

A power source connector device includes a first connector and a second connector. The first connector includes a first housing and first terminals. The second connector includes second terminals. The second terminals face each other at least partially with a space in between. When the first connector and the second connector fit to each other, a portion of the first housing is disposed in the space. At the same time, a portion of an outer wall of one of the first connector and the second connector abuts an inner wall of the other of the second connector or the first connector. An engaging portion is disposed on the outer wall, and a corresponding engaging portion for engaging with the engaging portion is disposed on the inner wall. The engaging portion is supported using the first housing disposed in the space.

9 Claims, 14 Drawing Sheets

POWER SOURCE CONNECTOR DEVICE

BACKGROUND OF THE INVENTION AND RELATED ART STATEMENT

The present invention relates to a power source connector device. In particular, the present invention relates to a power source connector device having a first connector and a second connector capable of connecting to each other.

Patent Reference discloses an example of a conventional connector device for connecting to an electrical power source shown in FIGS. 14 and 15. The conventional connector device has a configuration different from that of a signal connector device. More specifically, the conventional connector device is configured to flow an electrical current at a high voltage, so that the conventional connector device can be connected to an electrical power source. FIG. 14 is a perspective view showing the conventional connector device. FIG. 15 is a perspective sectional view showing the conventional connector device.

Patent Reference: Japanese Patent Application Publication No. 2009-4247

According to Patent Reference, the conventional connector device includes a connector 100 and a base housing 103. The connector 100 is connected to electric wire cables 107. The base housing 103 is mounted on a circuit board. The connector 100 is formed as an L-shaped connecting type connector. The connector 100 is fitted to the base housing 103 in a vertical direction. In other words, the connector 100 is attached to the base housing 103 in a direction perpendicular to an attachment surface of the circuit board.

In the conventional connector device, the base housing 103 has insertion holes 103*h*. A spring terminal 102 with a substantially U-character shape is disposed in each of the insertion holes 103*h*. The spring terminal 102 is narrowed at an upper portion thereof so that the spring terminal 102 is able to tightly hold a power terminal 150 with a flat plate shape.

In the conventional connector device, the connector 100 includes a socket housing 105. The socket housing 105 has insertion portions 105*w* with a protruding shape. The insertion portions 105*w* are inserted in the insertion holes 103*h* with a recessed shape provided in the base housing 103.

In the conventional connector device, an engaging portion 105*g* (a supporting portion 105*g*) is disposed on a front portion of the socket housing 105 (a portion of the socket housing 105 on an opposite side to the wire cables 107 extending out), so that the engaging portion 105*g* is movable relative to a main body of the socket housing 105. When the connector 100 is fitted to the base housing 103, the power source terminals 150 provided on the socket housing 105 contact with the spring terminals 102 provided on the base housing 103. At the same time, an engaging portion (not illustrated) provided on the engaging portion 105*g* of the socket housing 105 engages with a corresponding engaging portion 110 provided on the base housing 103 from outside of the base housing 103.

Recently, an electrical device such as a liquid crystal display television tends to have an enlarging size. As a result, it is necessary for the conventional power source connector device to handle a high voltage level as high as 600 V of the electrical device. When a large voltage is applied to the terminals of the conventional power source connector device, a potential difference between the terminals tends to become excessively high, thereby causing a short circuit between the terminals.

In order to prevent the short circuit between the terminals, if a distance between the terminals is increased, the conventional power source connector device tends to have a large size. Accordingly, it is difficult to effectively utilize a space between the terminals. Therefore, it has been demanded for the conventional power source connector device to prevent the short circuit between the terminals without increasing the distance between the terminals, i.e., without increasing the size of the conventional power source connector device.

In view of the problems described above, an object of the present invention is to provide a power source connector device having an engaging structure so that it is possible to effectively prevent a short circuit between terminals of the power source connector device without increasing a size thereof.

Further objects and advantages of the present invention will be apparent from the following description of the present invention.

SUMMARY OF THE PRESENT INVENTION

In order to attain the objects described above, according to a first aspect of the present invention, a power source connector device includes a first connector and a second connector, which can fit to each other. The first connector includes a first housing and two or more first terminals. The second connector includes two or more second terminals, which can contact with the two or more first terminals. The two or more second terminals face each other at least partially with a space in between.

According to the first aspect of the present invention, when the first connector and the second connector fit to each other, at least a portion of the first housing is disposed in at least a portion of the space. At the same time, at least a portion of an outer wall of one of the connectors, i.e., the first connector and the second connector, abuts at least a portion of an inner wall of the other of the connectors, i.e., the second connector or the first connector. An engaging portion is disposed on the outer wall on an abutting side thereof, and a corresponding engaging portion for engaging with the engaging portion is disposed on the inner wall on an abutting side thereof. When the first connector is connected to the second connector, the engaging portion is supported using at least a portion of the first housing disposed in at least a portion of the space.

According to the first aspect of the present invention, in the power source connector device, when the first connector is connected to the second connector, at least a portion of the first housing is situated in the space between the second terminals. Accordingly, it is possible to more effectively prevent short circuit between the second terminals. In addition, an engaging structure (the engaging portion and the corresponding engaging portion) is provided between the outer wall and the inner wall of the first connector and the second connector. Accordingly, it is possible to prevent a size of the connector device from increasing. Furthermore, a member for supporting the engaging structure is provided to prevent the short circuit between the second terminals. Accordingly, it is possible to provide the engaging structure without increasing the size of the connector device.

According to a second aspect of the present invention, the engaging portion may be configured to elastically displace with an elastic engaging portion. The elastic engaging portion is supported using a portion of the first housing, which is disposed in at least a portion of the space when the first connector is connected to the second connector.

According to the second aspect of the present invention, the elastic engaging portion may require a relatively large space. However, the elastic engaging portion can be disposed between the outer wall of the one of the second connector or the first connector and the inner wall of the other of the second connector or the first connector. Accordingly, it is possible to prevent the size of the connector device from increasing. In addition, the member for supporting the engaging structure is provided to prevent the short circuit between the second terminals. Accordingly, it is possible to prevent the short circuit between the second terminals without increasing the size of the connector device.

According to a third aspect of the present invention, in the power source connector device, the two or more second terminals may be formed of flat terminals, and the two or more second terminals are arranged so as to be substantially parallel to each other.

According to the third aspect of the present invention, when the second terminals are formed in the flat shape, it is possible to minimize the space, thereby making it possible to reduce the size of the connector device. In addition, when the two or more terminals are arranged so as to be substantially parallel to each other, it is possible to more effectively prevent the short circuit.

According to a fourth aspect of the present invention, in the power source connector device, the two or more second terminals may be arranged to face each other at least a portion thereof, via at least a portion of the second housing and the space.

According to the fourth aspect of the present invention, it is also possible to prevent short circuit between the terminals by at least a portion of the first housing between the portions of the second terminals, which are embedded in the second housing.

According to a fifth aspect of the present invention, in the power source connector device, the second connector may be configured to be mounted on a circuit board.

According to a sixth aspect of the present invention, in the power connector, the first connector may be configured to connect to the second connector in a direction substantially perpendicular to the circuit board.

According to a seventh aspect of the present invention, a guiding member may be formed respectively on the first connector and the second connector so as to guide the first connector to the second connector.

According to the seventh aspect of the present invention, when the first connector is connected to the second connector in the direction perpendicular to the circuit board, it is possible to easily connect the first connector to the second connector.

According to an eighth aspect of the present invention, an electric wire cable may be connected to the first connector, so that the electric wire cable extends in a direction substantially along a surface of the circuit board.

According to the eighth aspect of the present invention, the electric wire cable extends in the direction along the surface of the circuit board. Accordingly, it is possible to effectively use a space above and below the electric wire cable. Especially when the first connector is connected to the second connector in the direction substantially perpendicular to the circuit board, it is possible to more effectively use the space above and below the electric wire cable.

According to the present invention, it is possible to provide the power source connector device having the engaging structure. Accordingly, it is possible to effectively prevent the short circuit between power source terminals without increasing the size of the connector device.

DETAILED DESCRIPTION OF THE PREFERRED EMBODIMENTS

Hereunder, referring to the accompanying drawings, an embodiment of the present invention will be fully described. It should be noted that only preferred embodiments of the present invention will be described, and the embodiments shall not limit the present invention.

Figure 1:
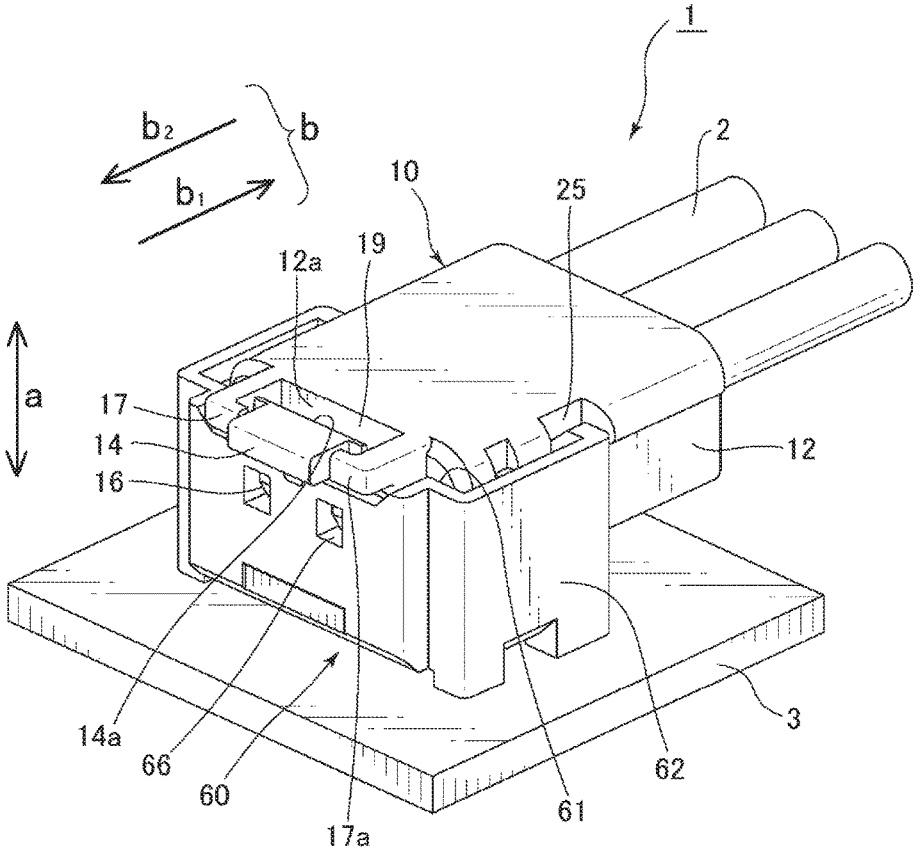
FIG. 1 is a perspective view showing a power source connector device in a state that a cable-side connector thereof is connected to a board-side connector thereof according to an embodiment of the present invention.

FIG. 1 is a perspective view showing a power source connector device 1 in a state that a cable-side connector 10 thereof is connected to a board-side connector 60 thereof according to an embodiment of the present invention.

Figure 2:
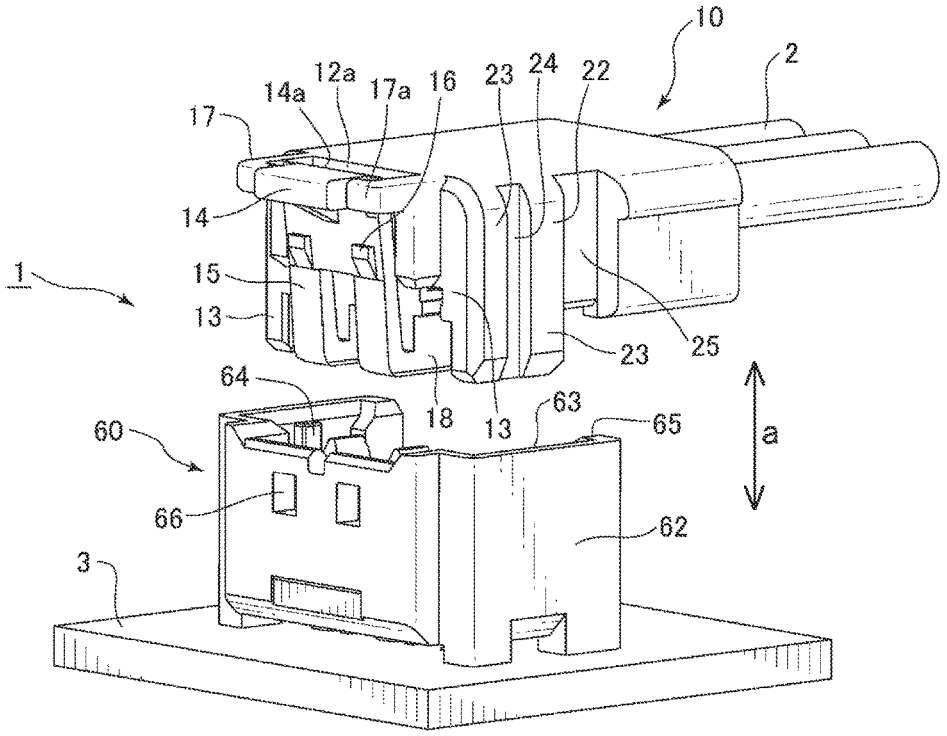
FIG. 2 is a perspective view showing the power source connector device viewed from a front side thereof in a state before the cable-side connector is connected to the board-side connector according to the embodiment of the present invention.

FIG. 2 is a perspective view showing the power source connector device 1 viewed from a front side thereof in a state before the cable-side connector 10 is connected to the board-side connector 60 according to the embodiment of the present invention.

Figure 3:
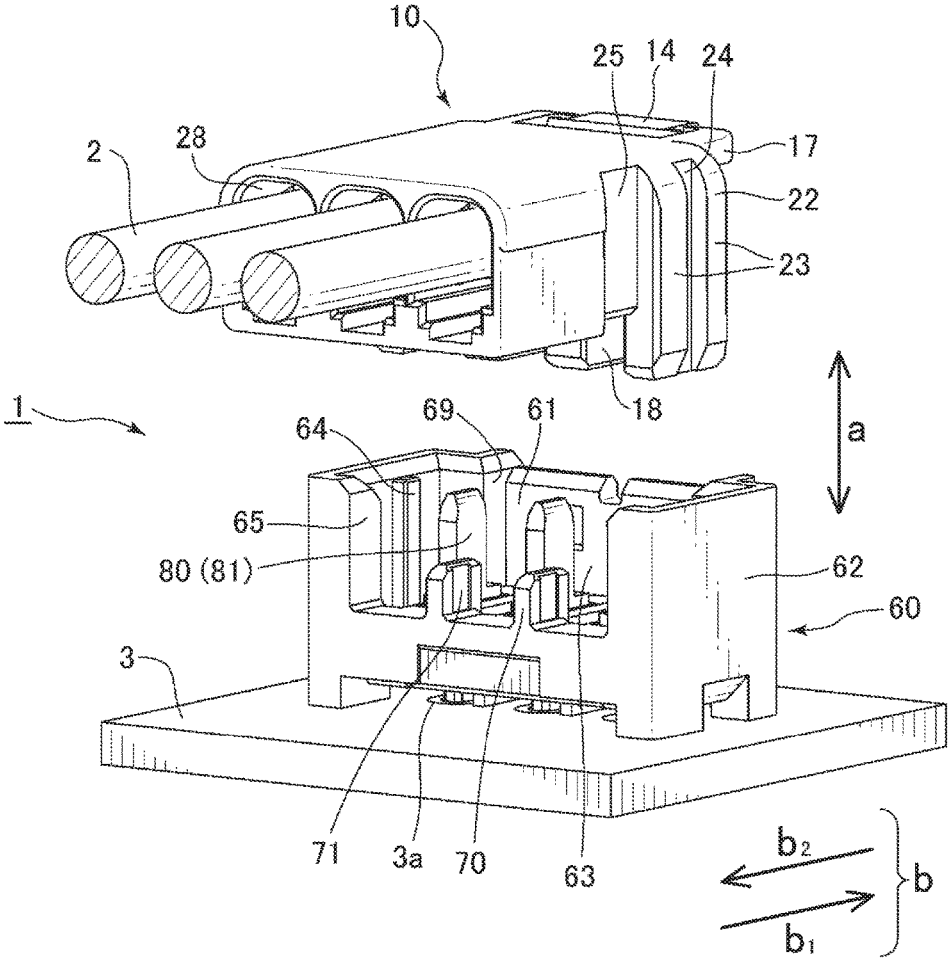
FIG. 3 is a perspective view showing the power source connector device viewed from a rear side thereof in the state before the cable-side connector is connected to the board-side connector according to the embodiment of the present invention.

FIG. 3 is a perspective view showing the power source connector device 1 viewed from a rear side thereof in the state before the cable-side connector 10 is connected to the board-side connector 60 according to the embodiment of the present invention.

FIGS. 1 through 3 are the perspective views showing the connector device 1 (referred to as the power source connector device 1) for connecting to a power source according to one preferred embodiment of the present invention.

It should be noted that the present invention relates to the power source connector device as shown in the accompanying figures, which is different from a signal connector device. It should be also noted that the scope of the present invention also includes a device having both a power connector and a signal connector.

According to the embodiment, the power source connector device 1 includes the connector 10 (the first connector 10 or the cable-side connector 10) and the connector 60 (the second connector 60 or the board-side connector 60). It should be noted that the connector 10 can be a cable-side connector to be connected to a wire cable 2, or can be a board-side connector to be mounted on a circuit board 3. Hereunder, the cable-side connector 10 and the board-side connector 60 will be described as an example.

According to the embodiment, the cable-side connector 10 is formed as a so-called a right-angled connector, which has a generally L-shape in a side view thereof. The cable-side connector 10 may be fit to the board-side connector 60, bringing the cable-side connector 10 close to the board-side connector 60 along a direction "a" indicated with an arrow in the figure, i.e., in a direction substantially perpendicular to a board surface of the circuit board 3. Having the fitting direction be substantially perpendicular to the board surface, it is easy to fit the cable-side connector 10 to the board-side connector 60. Here, "substantially" means that the fitting direction may not have to be strictly perpendicular to the board surface.

According to the embodiment, the electric wire cables 2 may be pulled out through pull-out holes provided on a rear side of the cable-side connector 10. The extending direction of the electric wire cables 2 is along the board surface of the circuit board 3. Again, "substantially" herein means that the extending direction may not have to be strictly along the board surface. Having the extending direction be along the board surface of the circuit board 3, it is possible to effectively use dead space above and below the wire cables 2, which is not possible by a so-called "straight-type" connector, i.e., connector in which the extending direction of an electric wire cables or the like is substantially perpendicular to the circuit board 3. Especially, as in this embodiment, when the fitting direction of the cable-side connector 10 and the board-side connector 60 is substantially perpendicular to the circuit board 3, the above-described effect may be expected to be higher.

As shown in FIG. 2, on a front surface of the cable-side connector 10, there is provided an elastic engaging portion 15 that is continuously joined to an operating portion 14, and engaging portions 16 under the operating portion 14. The elastic engaging portion 15 is provided so as to be displaceable along a direction "b", which is substantially perpendicular to the direction "a" indicated with the arrow in FIG. 2.

When the cable-side connector 10 is connected to the board-side connector 60, the engaging portions 16 displace in the directions "b1" and then "b2", so as to engage in the engaging holes 66. As a result, the cable-side connector 10 is locked on the board-side connector 60. This locked state may be released by moving the operating portion 14 in the direction "b1" indicated with the arrow in FIG. 2, i.e., a direction to move the elastic engaging portion 15 away from a front-side inner wall 61 of the board-side connector 60 (see FIGS. 1, 3, etc.). Here, the engaging portions 16 may be provided so as to be elastically displaceable with the elastic engaging portion 15 as in this embodiment, but may not have to be provided in this way.

According to the embodiment, the above-described locked state is achieved by so-called inner locking structure. With this inner locking structure, the elastic engaging portion 15 and the engaging portions 16 are disposed between an outer wall of the cable-side connector 10 and an inner wall of the board-side connector 60, e.g., between a front-side outer wall 13 of the cable-side connector 10 and a front-side inner wall 61 of the board-side connector 60 (see FIGS. 1, 3, etc.), when the cable-side connector 10 is connected to the board-side connector 60. Therefore, according to the configuration of the embodiment, the size of the connector device will not be increased by providing the engaging structure.

In the following description, the configuration of the board-side connecter 60 will be described in more detail, referring to FIGS. 4(*a*)-4(*b*) and 5(*a*)-5(*b*) as well as FIG. 1 through FIG. 3.

Figure 4:
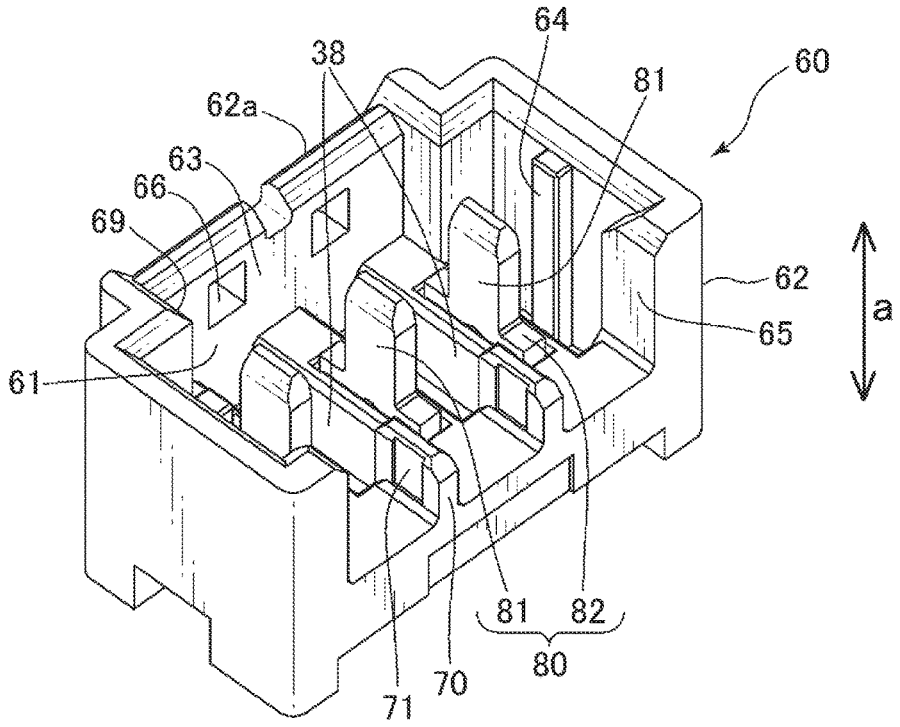
FIGS. 4(*a*) and 4(*b*) are views showing the board-side connector of the power source connector device according to the embodiment of the present invention, wherein FIG. 4(*a*) is a perspective view of the board-side connector viewed from an upper portion thereof and FIG. 4(*b*) is a front view of the board-side connector.
Figure 4:
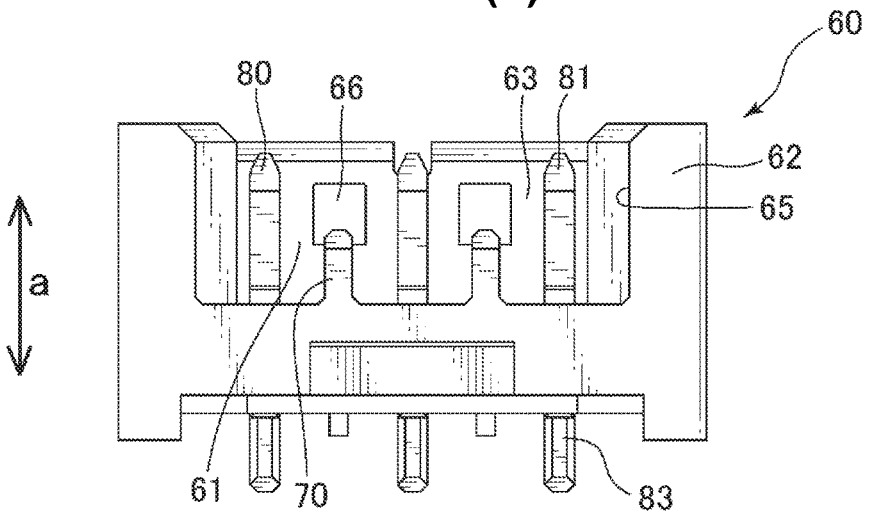

FIGS. 4(*a*) and 4(*b*) are views showing the board-side connector 60 of the power source connector device 1 according to the embodiment of the present invention, wherein FIG. 4(*a*) is a perspective view of the board-side connector 60 viewed from an upper portion thereof and FIG. 4(*b*) is a front view of the board-side connector 60.

Figure 5:
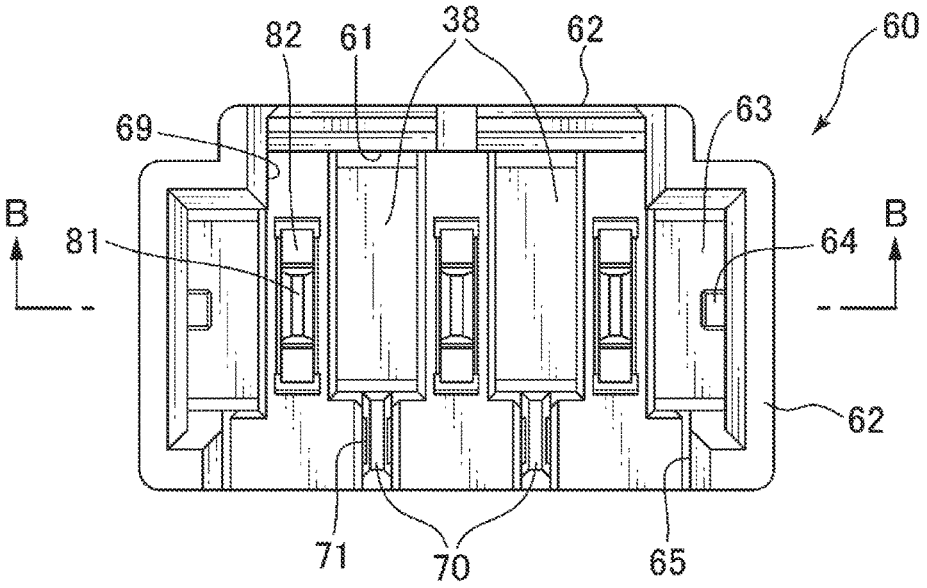
FIGS. 5(*a*) and 5(*b*) are views showing the board-side connector of the power source connector device according to the embodiment of the present invention, wherein FIG. 5(*a*) is a plan view of the board-side connector viewed and FIG. 5(*b*) is a sectional view of the board-side connector taken along a line B-B in FIG. 5(*a*)
Figure 5:
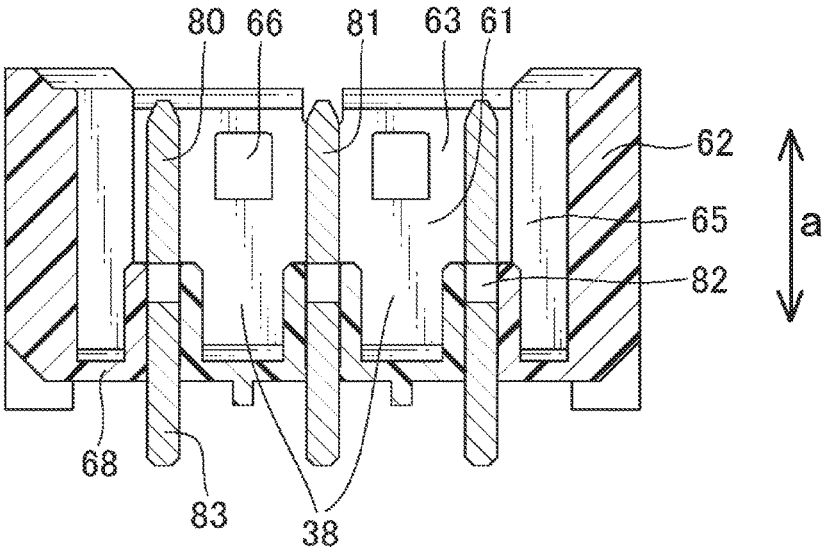

FIGS. 5(*a*) and 5(*b*) are views showing the board-side connector 60 of the power source connector device 1 according to the embodiment of the present invention, wherein FIG. 5(*a*) is a plan view of the board-side connector 60 viewed and FIG. 5(*b*) is a sectional view of the board-side connector 60 taken along a line B-B in FIG. 5(*a*).

In the embodiment, the board-side connector 60 includes a board housing (second housing) 62, and a plurality of flat power source terminals 80, which are to be attached to the board housing 62.

In the embodiment, the board housing 62 is made of an insulating material such as resin, and is mounted on a board, for example, being upright thereon. The board housing 62 generally has a shape of a rectangular parallelepiped. The board housing 62 is opened on the side of an upper surface thereof, to which the cable-side connector 10 comes close and fit, and on the rear side thereof, which is an extending side of the electric wire cable 2. The board-side housing 62 has a concave inserting portion 63 therein for fitting the cable-side connector 10 thereto.

In the embodiment, a portion of the board housing 62, which is near the center of the front wall thereof, protrudes frontward and thereby a stair-like portion 69 is formed. The stair-like portion 69 serves for positioning the cable-side connector 10 and the board-side connector 60 relative to each other upon fitting the cable-side connector 10 to the board-side connector 60. With the stair-like portion 69, a front protruding portion 62*a* protrudes. The front protruding portion 62*a* has engaging holes 66, which are corresponding engaging portions to engage with the engaging portions 16 provided on the cable-side connector 10. Here, the engaging holes 66 can be any as long as it can engage with the engaging portions 16. Here, the engaging holes 66 do not have to be provided as through holes, but for example, they can be dents.

At a rear end of the board housing 62, there is provided a protruding portions 65, which are formed as protrusions that protrude from both side walls towards the center thereof. Similarly, at a rear end of the board housing 62, there are provided convex portions 64, which are formed as protrusions that protrude towards the center at generally center of inner side walls of the board housing 62. The protruding portions 65 and the convex portions 64 are respectively formed to extend in a direction "a" indicated with the arrow in FIG. 3.

In the insertion portion 63, a plurality of the flat power source terminals 80 and a plurality of upright portions 70, i.e., three flat power source terminals 80 and two upright portions 70 in the embodiment, are provided upright, directing upward, relative to the fitting side of the cable-side connector 10. The flat power source terminals 80 and the upright portions 70 may be, for example, disposed being parallel to each other along the extending direction of the electric wire cables 2 and alternately arranged along a left-and-right direction.

In the embodiment, the flat power source terminals 80 are respectively disposed at generally similar positions to each other in a front-and-back direction. The upright portions 70 are respectively disposed at generally similar positions to each other in a front-and-back direction. Therefore, the flat power source terminals 80 are facing each other at least in part and the upright portions 70 are facing each other at least in part. Therefore, the flat power source terminals 80 and the upright portions 70 do not face to each other.

In addition, there is no upright portion 70 present in the space 38 formed between the flat power source terminals 80, where the flat power source terminals 80 face each other. Here, the number of the flat power source terminals 80 may be enough as long as it is at least two. For example, the number of the flat power source terminals 80 can be three or more. In addition, the upright portions 70 may not have to be provided, and can be omitted. According to this configuration, the engaging holes 66 are disposed in an extended line from the upright portions 70, which is along the extending direction of the electric wire cables 2.

In the embodiment, the flat power source terminals 80 may have similar shapes to each other. For example, a plurality of the flat power source terminals 80 may be made at once, by punching out a flat sheet metal while keeping its sheet surface. Keeping the sheet surface, it is easy to make the flat power source terminals 80, and it is possible to keep the manufacturing cost low. Moreover, with the flat shape, it is possible to reduce space to dispose the flat power source terminals 80.

Needless to say, the shape of the flat power source terminals 80 may not be limited to the one described above. For example, each of the flat power source terminals 80 may have a vertically long shape, which has a generally cross-like shape in a side view thereof (which is well shown in FIG. 13 that will be described below). For example, each of the flat power source terminals 80 may have a contact portion 81, a wide base portion 82, and a mounting portion 83.

In the embodiment, the wide base portion 82 is provided near a center of each of the flat power source terminals 80. The contact portions extend upward from the base portions 82. The mounting portions 82 extend downward from the base portions 82. Most part of the base portions 82 and upper half portions of the mounting portions 83 are provided so as to be secured in the board housing 62. The contact portions 81 are provided in the insertion portion 63 of the board housing 62, while being exposed to outside. Lower half portions of the mounting portions 83 are provided so as to be exposed to outside of the board housing 62.

In the embodiment, the lower half portions of the mounting portions 83 are portions used for soldering the flat power source terminals 80 onto the circuit board 3 upon mounting on the circuit board 3. The lower half portions of the mounting portions 83 are disposed while penetrating a bottom plate 68 of the board housing 62 and the board plate 3. On the circuit board 3, there is provided through holes 3*a* to pass through the mounting portions 82.

The power source terminals 80 remain facing each other via the space 38 formed between the flat power source terminals 80 and at least a portion of the board housing 62. The flat power source terminals 80 do not have to face each other over their whole surfaces, but can work as long as the flat power source terminals 80 at least partially face each other. The exposed lower half portions of the mounting portions 82 and contact portions 81 face each other only via the space 38. Most part of the base portions 82 and the upper half portions of the mounting portions 82 face each other via both at least portion of the spaces 38 and the base housing 62.

When the cable-side connector 10 is connected to the board-side connector 60, in those spaces 38, at least a portion of the cable housing 12 (supporting portions 18) can be disposed. When the flat power source terminals 80 face each other over their whole surfaces, short circuit may especially easily occur. However, even in the case like this, according to the configuration of the embodiment, it is possible to effectively prevent the short circuit.

In the following description, the configuration of the cable-side connector 10 will be described in more detail, referring to FIGS. 6 and 7(*a*)-7(*c*) as well as FIGS. 1 through 3.

Figure 6:
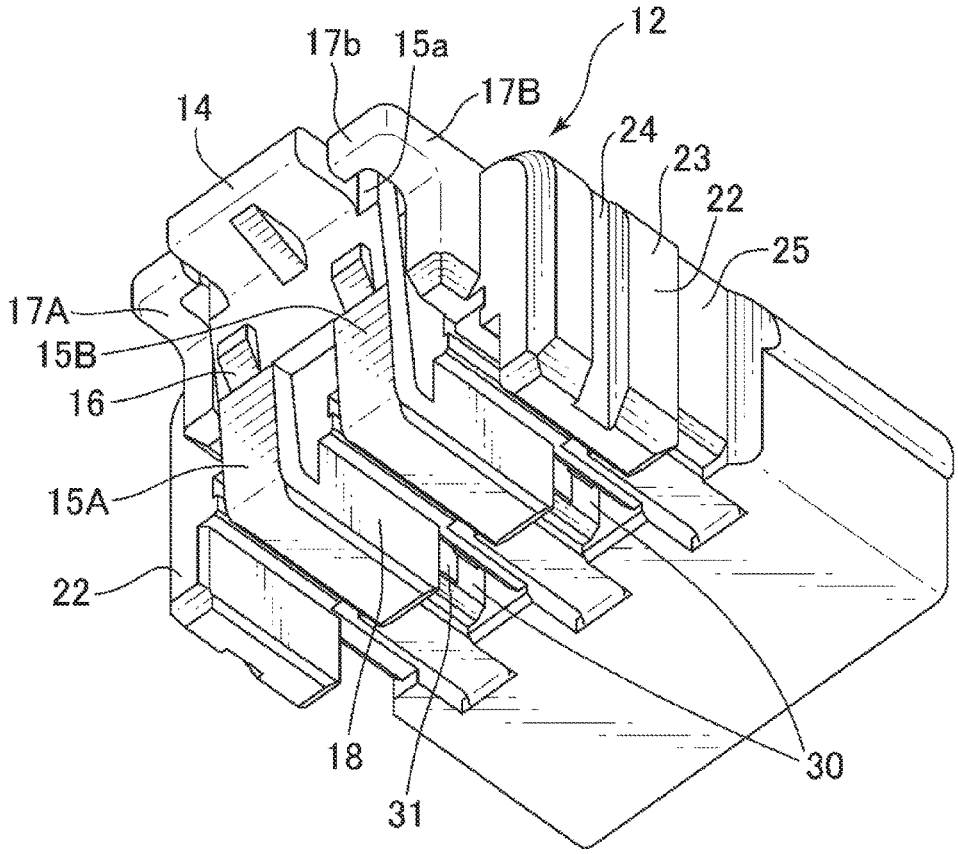
FIG. 6 is a perspective view showing the cable-side connector of the power source connector device viewed from a bottom side thereof according to the embodiment of the present invention.

FIG. 6 is a perspective view showing the cable-side connector 10 of the power source connector device 1 viewed from a bottom side thereof according to the embodiment of the present invention.

Figure 7:
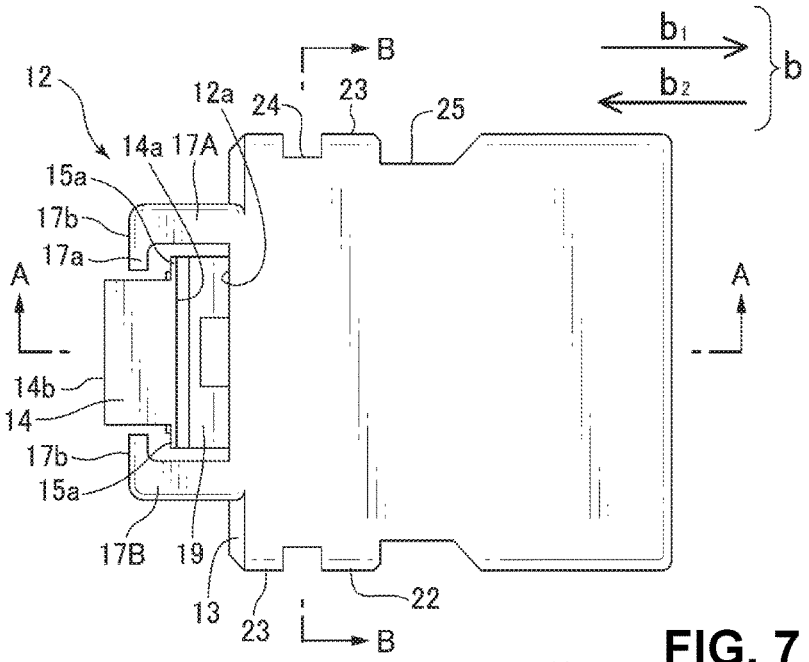
FIGS. 7(*a*), 7(*b*), and 7(*c*) are views showing the cable-side connector of the power source connector device according to the embodiment of the present invention, wherein FIG. 7(*a*) is a top view of the cable-side connector, FIG. 7(*b*) is a sectional view of the cable-side connector taken along a line A-A in FIG. 7(*a*), and FIG. 7(*c*) is a sectional view of the cable-side connector taken along a line B-B in FIG. 7(*a*)
Figure 7:
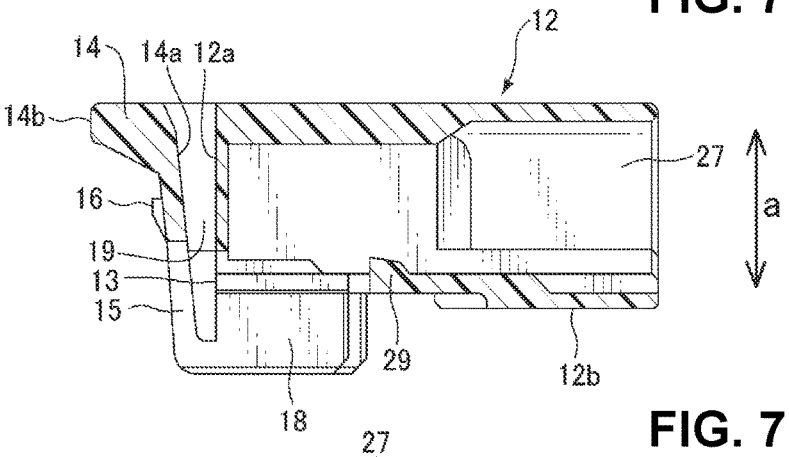
Figure 7:
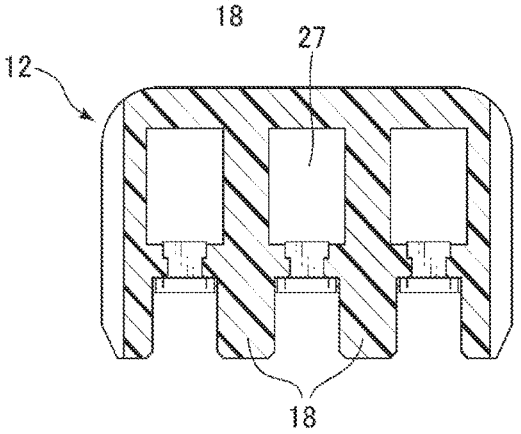

FIGS. 7(*a*), 7(*b*), and 7(*c*) are views showing the cable-side connector 10 of the power source connector device 1 according to the embodiment of the present invention, wherein FIG. 7(*a*) is a top view of the cable-side connector 10, FIG. 7(*b*) is a sectional view of the cable-side connector 10 taken along a line A-A in FIG. 7(*a*), and FIG. 7(*c*) is a sectional view of the cable-side connector 10 taken along a line B-B in FIG. 7(*a*).

In the embodiment, the cable-side connector 10 includes a cable housing (first housing) 12, and a plurality of power source terminals 40. The plurality of power source terminals 40 is attached to the cable housing 12.

Similarly to the board housing 62, the cable housing 12 is made of an insulating material, such as resin. The cable housing 12 has a generally L-shape in its side view, and has a generally box-like shape as a whole.

Between a rear surface 14*a* of the operating portion 14 and a front surface 12*a* of the housing 12 main body, there is formed a gap 19 so as to allow the operating portion 14 to displace by the elastic engaging portion 15. In order to prevent excess displacement of the operating portion 14 to the direction "b2" and prevent damage of the elastic engaging portion 15, there is provided two restraining members 17A and 17B on the front side of the cable-side connector 10. Each of the two restraining members 17A and 17B has a generally L-shape.

In the embodiment, the restraining members 17A and 17B respectively project so as to surround outer circumference of the side portion of the operating portion 14. When an excess force is applied so as to displace the operating portion 14 in the direction "b2", the protruding portions 17*a*, which protrude toward the center, collide to the front portion 15*a* of the elastic engaging portion 15.

From between the protruding portions 17*a* of the restraining members 17A and 17B, front end 14*b* of the operating portion 14 protrudes more than the front ends 17*b* of the restraining members 17. Therefore, an operation of the operating portion 14 towards the direction "b" will not be bothered. Here, the amount of the protrusions of the front end 14*a* of the operating portion 14 from the front ends 17*b* of the restraining members 17 may be set so as to be just enough to release the lock while the front end 14*a* of the operating portion 14 and the front ends 17*b* of the restraining members 17 are at the same position. Here, the restraining members also serve to prevent entrance of the cable 2 into the gap 19.

On the both side surfaces of the cable housing 12 at the front side thereof, there is provided an arm 22 extending towards the board-side connector 60. Each of the arms 22 has two ribs 23 to reinforce the arm 22. The ribs 23 extend in the direction "a" indicated with the arrow in FIG. 2 and the two ribs on each side form a concave portion 24 therebetween. Upon fitting the cable-side connector 10 to the board-side connector 60, the convex portion 64 of the board-side connector 60 is guided to fit in the concave portion 24. Similarly, on a side of a rear-side surface of each of the arms 22, there is provided a groove 25.

Upon fitting the cable-side connector 10 to the board-side connector 60, the protruding portions 65 of the board-side connector 60 are guided to fit in the grooves 25. Here, instead of the above configuration, the cable-side connector 10 can have the convex portions 64 and the board-side connector 60 can have the concave portions 24. Similarly, the cable-side connector 10 can have protruding portions 65 and the board-side connector 60 can have the grooves 25 as guiding members.

Figure 8:
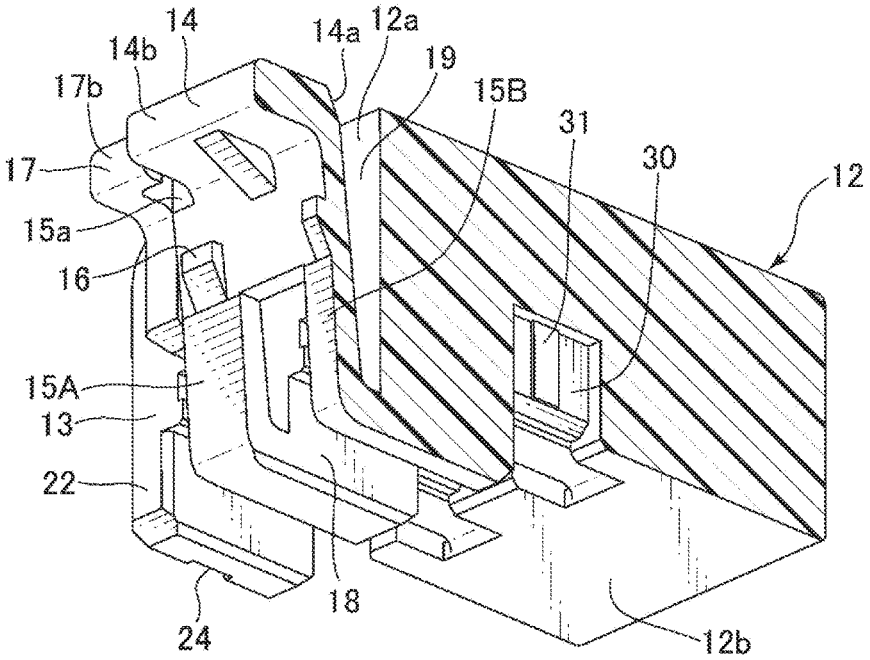
FIG. 8 is a perspective sectional view showing a cable housing of the cable-side connector of the power source connector device viewed from a bottom side thereof according to the embodiment of the present invention.

FIG. 8 is a perspective sectional view showing the cable housing 12 of the cable-side connector 10 of the power source connector device 1 viewed from a bottom side thereof according to the embodiment of the present invention. FIG. 8 shows a cut plane of the cable housing 12, which is cut in a front-and-back direction at a position so as to be able to see inside of the insertion hole 30. On the bottom 12*b* of the housing 12 main body of the cable housing 12, there is provided the insertion holes 30. On the board-side housing 62, there are provided upright portions 70.

Upon fitting the cable-side connector 10 to the board-side connector 60, the upright portions 70 are inserted to the insertion holes 30. As obvious from FIG. 8, on an inner wall of each of the insertion holes 30, there is formed a convex portion 31. Upon inserting the upright portions 70 of the board-side housing 62 into the insertion holes 30, the convex portions 31 on the inner walls of the insertion holes 30 fits to the concave portions 71 of the upright portions 70. As a result, it is easy to define a moving direction of the cable-side connector 10 and the board-side connector 60. Moreover, when the cable-side connector 10 is pulled in a leading direction of the wire cables 2 or pulled upward, such pulling force may be reduced by the upright portions 70 and the insertion holes 30.

On an outer wall of the front portion of the cable-side connector 10, there is provided elastic engaging portion 15. The elastic engaging portion 15 is formed as two arms 15A and 15B, which extend like cantilevers. The arms 15A and 15B can elastically displace in generally front-and-back direction on the outer wall of the front portion of the cable housing 12. Upper ends of the arms 15A and 15B may be joined to each other, for example with the operating portion 14.

On the other hand, lower ends of the arms 15A and 15B are respectively and separately supported by supporting portions 18. The supporting portions 18 are formed as a portion of the cable housing 12. For example, the lower ends of the arms 15A and 15B are supported, while extending out upward from bottoms of front walls of the supporting portions 18. Each of the supporting portions 18 is positioned in front of the insertion hole 30, but behind the elastic engaging portion 15.

In addition, each of the supporting portions 18 has specific thickness (dimension in a lateral (left-and-right) direction on the front side), a specific height (dimension in the up-and-down direction), and a specific width (dimension in the front-and-back direction), and enough strength to support the arms 15A and 15B. The supporting portions 18 are disposed between the terminal insertion holes 27 in the left-and-right direction, and protrude downward from the bottom 12*b* of the housing main body of the cable housing 12.

With the supporting portions 18 and the elastic engaging portion 15, i.e., the arms 15A and 15B, joined to the supporting portions 18, which are configured as described above, it is possible to have a long dimension of the elastic engaging portion 15 in the up-and-down direction (the direction "a" indicated with the arrow in the figure), and to secure easiness to displace for a certain amount. The engaging portions 16 may be provided near a boundary portion between the operating portion 14 and the arms 15A and 15B. The engaging portions 16 can elastically displace with the arms 15A and 15B.

From now on, referring to FIGS. 9 and 10(*a*)-10(*b*), the power source terminals 40 will be described in more detail.

Figure 9:
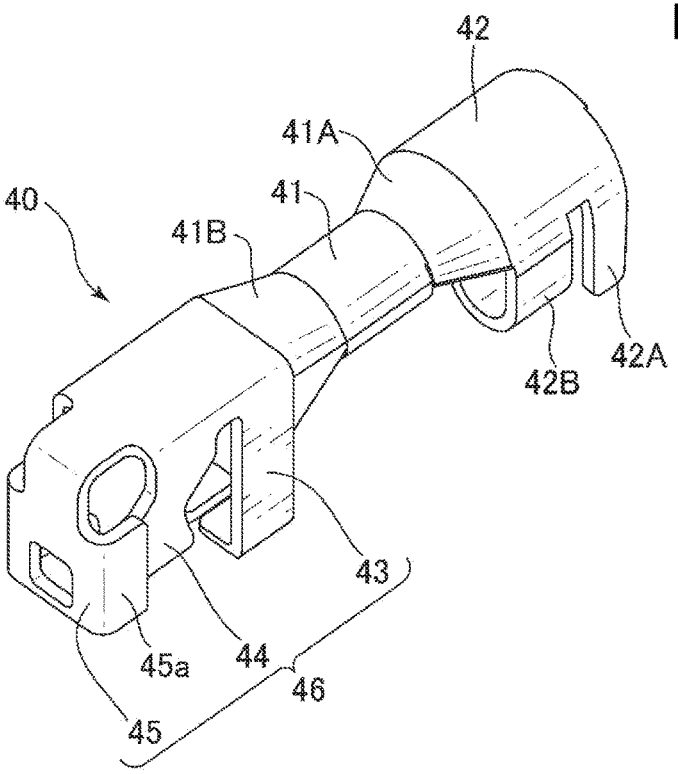
FIG. 9 is a perspective view showing a power source terminal of the cable-side connector of the power source connector device viewed from an upper side thereof according to the embodiment of the present invention.

FIG. 9 is a perspective view showing the power source terminal 40 of the cable-side connector 10 of the power source connector device 1 viewed from an upper side thereof according to the embodiment of the present invention.

Figure 10:
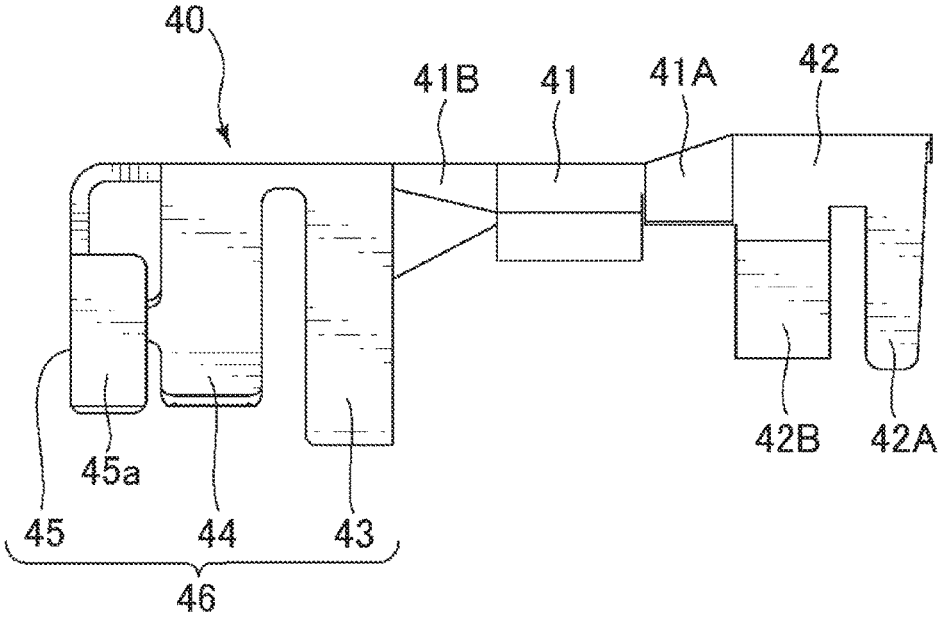
FIGS. 10(*a*) and 10(*b*) are views of the power source terminal of the cable-side connector of the power source connector device according to the embodiment of the present invention, wherein FIG. 10(*a*) is a side view of the power source terminal and FIG. 10(*b*) is a bottom view of the power source terminal.
Figure 10:
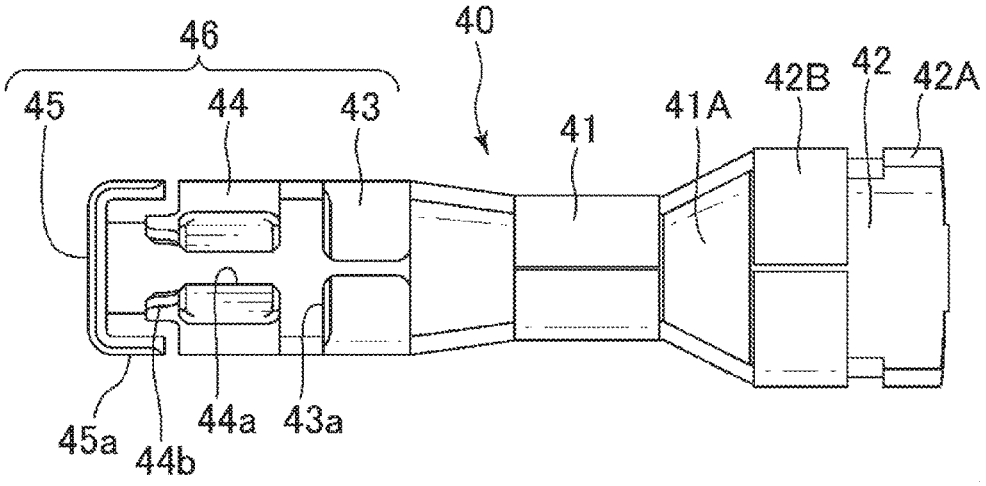

FIGS. 10(*a*) and 10(*b*) are views of the power source terminal 40 of the cable-side connector 10 of the power source connector device 1 according to the embodiment of the present invention, wherein FIG. 10(*a*) is a side view of the power source terminal 40 and FIG. 10(*b*) is a bottom view of the power source terminal 40.

Each of the power source terminals 40 is made by punching one sheet metal and then bending. Each of the power source terminals 40 includes a cable holding portion 42, a wire penetrating portion 41, and a contact portion 46 in the order from the rear side to the front side thereof. Furthermore, each of the power source terminals 40 includes a sloped portion 41B to join the wire penetrating portion 41 and the contact portion 46. The number of the power source terminals 40 may be enough if it is at least two, but in this embodiment, there are three power source terminals 40 are provided corresponding to the number of power source terminals 80 provided in the board-side connector 60.

In order to hold the wire cables 2, the cable-holding portions 42 are formed having relatively large diameters. Each of the cable-holding portions 42 includes a small portion 42A and a large portion 42B. The small portions 42A serve to secure the wire cables 2. At least the large portions 42B are to be swaged to hold the wire cables 2. On the other hand, the wire penetrating portions 41 are for putting the wires therein, which are conductive portions inside the wire cables. Therefore, the wire penetrating portions 41 are formed having relatively small diameters.

In the embodiment, the contact portion 46 is provided at the end of each of the power source terminals 40, and has a generally box-like shape. Each of the contact portions 46 includes a lance engaging portion 43, a contact portion 44, and an abutting surface 45 in the order from the rear side to the front side thereof. An end of each of the lance engaging portions 43 may be bent, for example, at a right angle towards the center, but the bending angle can be any as long as it is possible to engage with a portion (lance 29) of the cable housing 12. Each of the contact portions 44 has generally a U-shape with an upper portion being made smaller so as to tightly hold the flat power source terminal 80. At the portion to hold the flat power source terminal 80, there is formed a contact portion 44*a*. There is formed a bent portion 45*a* from the abutting surface 45 towards the contact portion 44. Each of the bent portions 45*a* interferes with a protrusion 44*b* provided at an end of each contact portions 46. With the above-described configuration, it is possible to prevent excess outward deformation of the contact portions 44.

Figure 11:
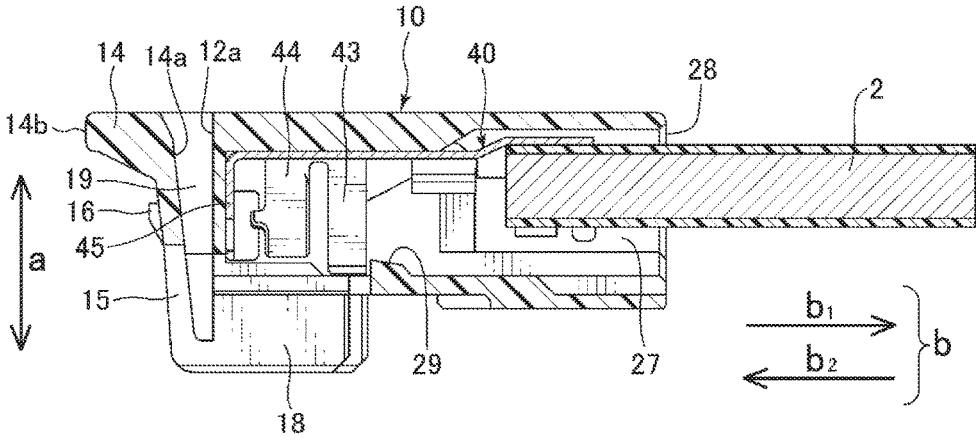
FIGS. 11(*a*) and 11(*b*) are views showing the cable-side connector of the power source connector device in a state that the power source terminal is disposed in the cable housing according to the embodiment of the present invention, wherein FIG. 11(*a*) is a sectional view of the cable-side connector corresponding to FIG. 7(*b*) and FIG. 11(*b*) is a sectional view of the cable-side connector taken corresponding to FIG. 7(*c*)
Figure 11:
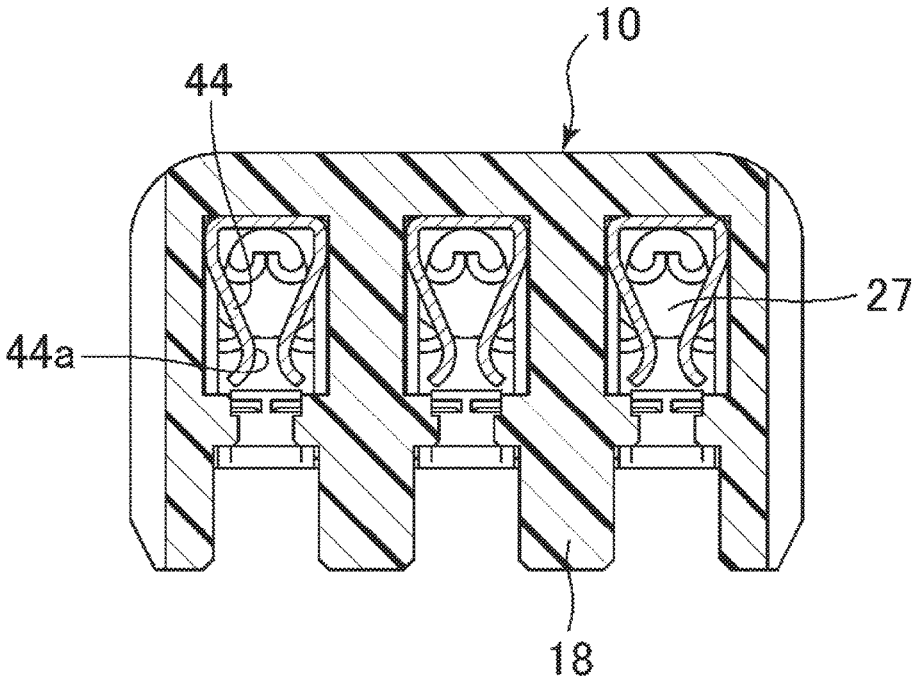

FIGS. 11(*a*) and 11(*b*) are views showing the cable-side connector 10 of the power source connector device 1 in a state that the power source terminal 40 is disposed in the cable housing 12 according to the embodiment of the present invention, wherein FIG. 11(*a*) is a sectional view of the cable-side connector 10 corresponding to FIG. 7(*b*) and FIG. 11(*b*) is a sectional view of the cable-side connector 10 taken corresponding to FIG. 7(*c*);

Different from FIGS. 7(*b*) and 7(*c*), FIGS. 11(*a*) and 11(*b*) show the state that the power source terminals 40 are disposed in the cable housing 12. Each of the power source terminals 40 is inserted frontward from the rear side of the cable housing 12 through a terminal insertion hole 27 until the abutting surface 45 on its end hits the surface inside the connector 10.

Once each of the power source terminals 40 are inserted in the terminal insertion holes 27 and reach a certain position, a lance 29 provided on the bottom of the cable housing 12 is caught by the lance engaging portion 43. As a result, it is possible to prevent coming off of the power source terminals 40 from the terminal insertion holes 27. The lance 29 is provided in a direction along the direction "b2" indicated with the arrow in the figure, so as to extend frontward from the rear side, as a part of the cable housing 12. The lance 29 has a free end at the front side, so that the lance 29 can elastically displace in the direction "a" indicated with the arrow in the figure.

IN the following description, referring to FIGS. 12 and 13(*a*)-13(*b*), the fitting state of the cable-side connector 10 and the board-side connector 60 will be described.

Figure 12:
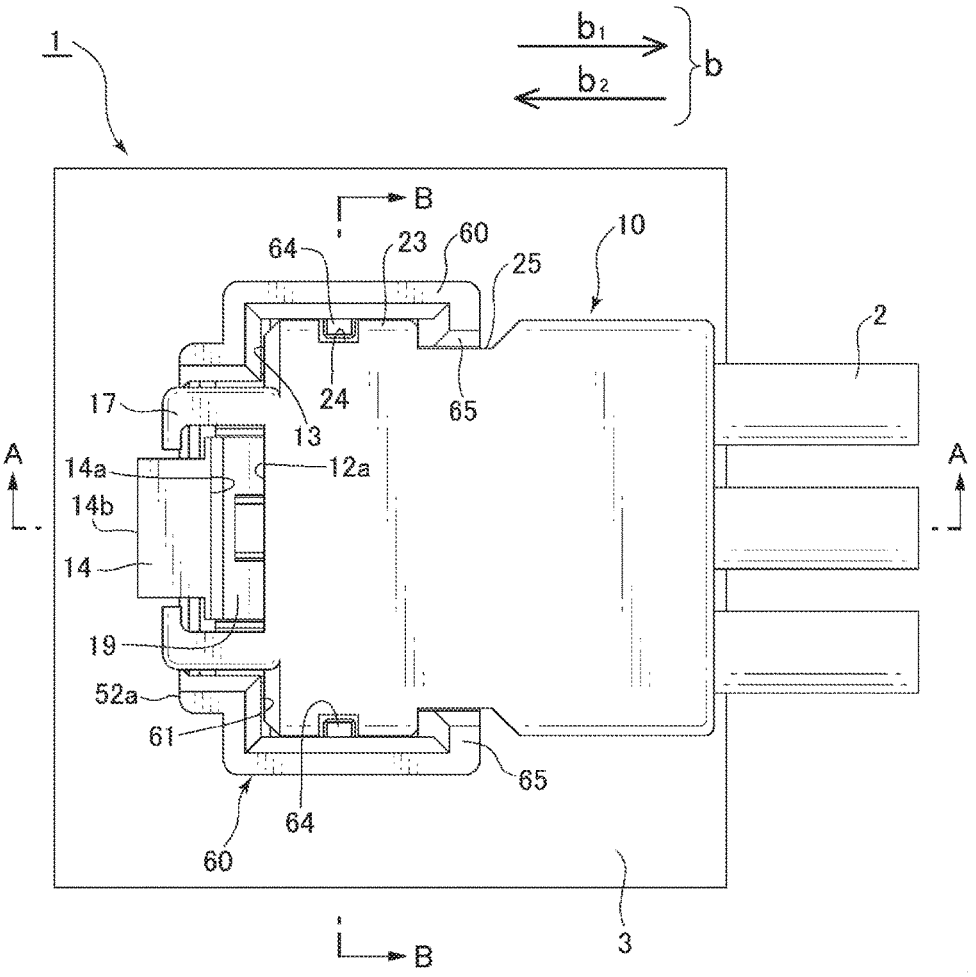
FIG. 12 is a plan view showing the power source connector device in the state before the cable-side connector is connected to the board-side connector according to the embodiment of the present invention.

FIG. 12 is a plan view showing the power source connector device 1 in the state before the cable-side connector 10 is connected to the board-side connector 60 according to the embodiment of the present invention.

Figure 13:
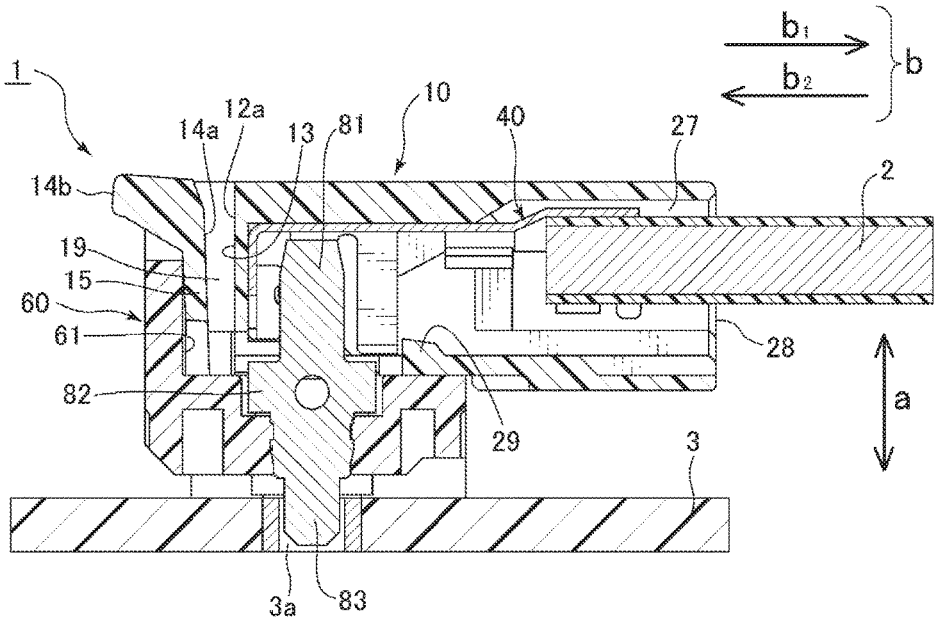
FIGS. 13(*a*) and 13(*b*) are sectional views showing the power source connector device in the state before the cable-side connector is connected to the board-side connector according to the embodiment of the present invention, wherein FIG. 13(*a*) is a sectional view of the power source connector device taken along a line A-A in FIG. 12, and FIG. 13(*b*) is a sectional view the power source connector device taken along a line B-B in FIG. 12.
Figure 13:
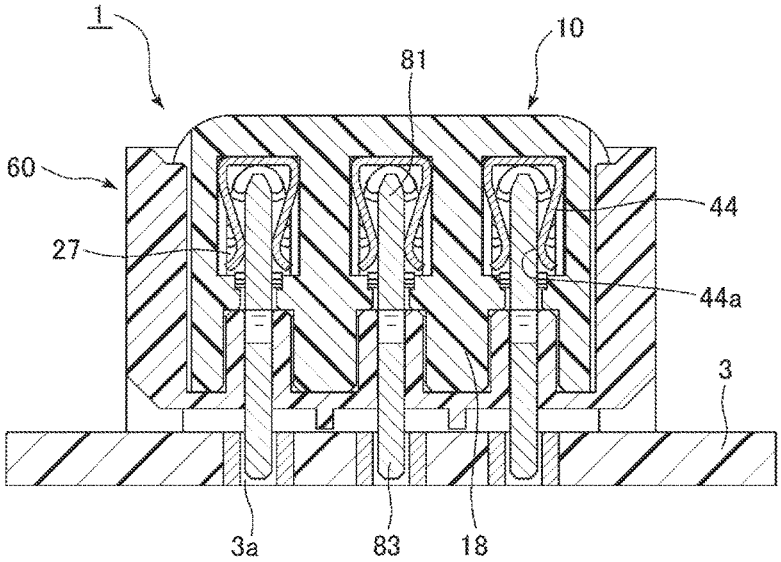
Figure 14:
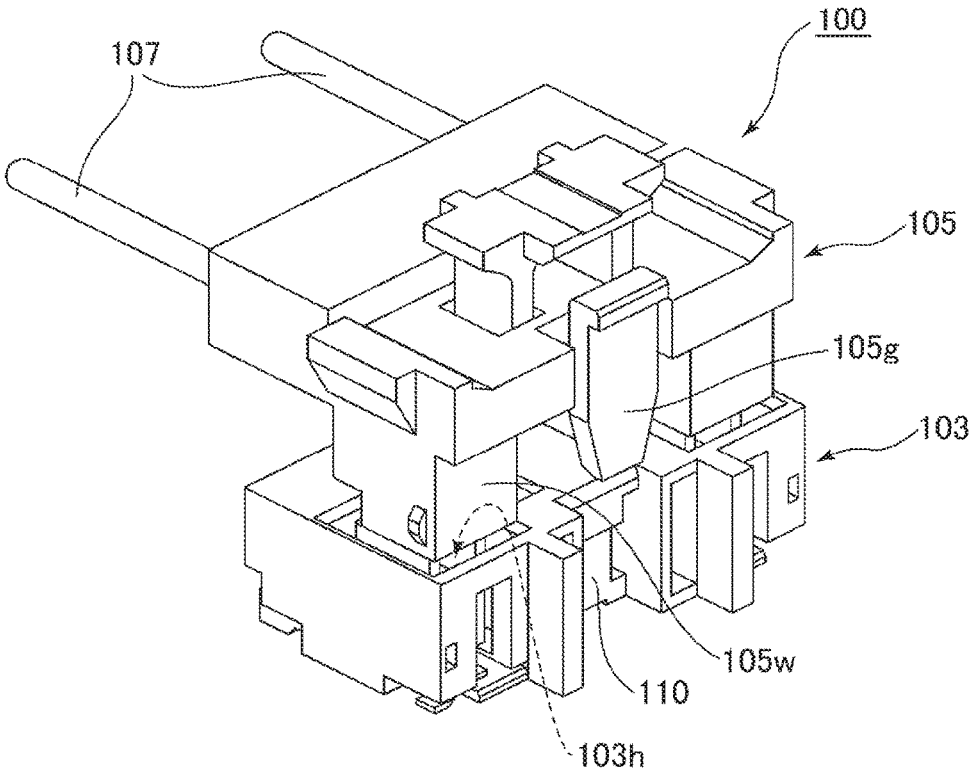
FIG. 14 Prior Art
FIG. 14 is a perspective view showing a conventional connector device.
Figure 15:
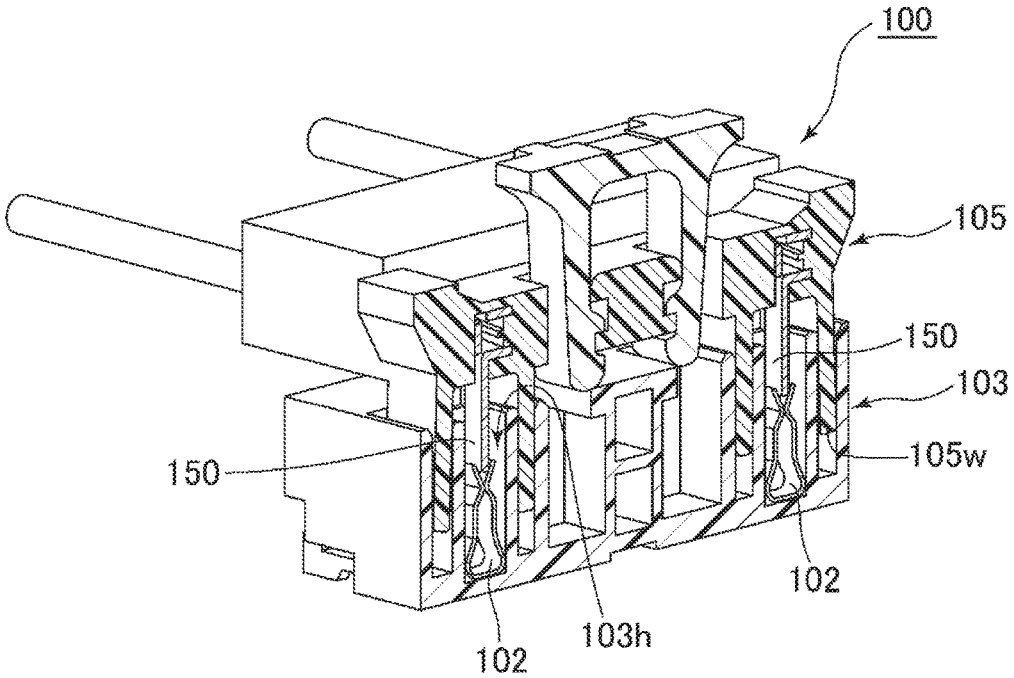
FIG. 15 Prior Art
FIG. 15 is a perspective sectional view showing the conventional connector device.

FIGS. 13(*a*) and 13(*b*) are sectional views showing the power source connector device 1 in the state before the cable-side connector 10 is connected to the board-side connector 60 according to the embodiment of the present invention, wherein FIG. 13(*a*) is a sectional view of the power source connector device 1 taken along a line A-A in FIG. 12, and FIG. 13(*b*) is a sectional view the power source connector device 1 taken along a line B-B in FIG. 12.

Upon fitting the cable-side connector 10 to the board-side connector 60, the flat power source terminals 80 are inserted between the contact portions 44*a* of the power source terminals 40. As a result, the power source terminals 40 and the flat power source terminals 80 contact to each other.

At this time, the outer wall 13 of the front surface of the cable-side connector 10, on which the elastic engaging portion 15 is provided, face the inner wall 61 of the front surface of the board-side connector 60. For example, as in this embodiment, the cable-side connector 10 can have engaging portions 16, which can elastically displace, by the elastic engaging portion 15 on the abutting side of the outer wall 13 on the front surface of the cable-side connector 10. Then, correspondingly, the board-side connector 60 can have corresponding engaging portions 66 on the abutting side of the inner wall 61 of the front portion of the board-side connector 60.

As a result, the elastic engaging portion 15 that requires relatively large space is disposed between the outer wall 13 of the front portion of the cable-side connector 10 and the inner wall 61 of the front portion of the board-side connector 60. Therefore, it is possible to provide a connector device having an engaging structure composed of the engaging portions 16 and the corresponding engaging portions 66, while preventing exposure of the elastic engaging portion 15 to outside.

In addition, upon fitting the cable-side connector 10 and the board-side connector 60, the supporting portions 18, each of which is a portion of the cable housing 12, are disposed in at least a portion of the space formed between the flat power source terminals 80. As a result, it is possible to make the distance along the surface long and to more effectively prevent short circuit between the flat power source terminals 80. Here, portions of each of the flat power source terminals 80 involved in the short circuit between the flat power source terminals 80 include most part of the base portion 82 and upper half portions of the mounting portions 83, which are secured inside the board housing 62, i.e., surrounded by the board housing 62, as well as the contact portion 81 exposed to outside at the insertion portion 63 of the board housing 62.

Furthermore, also at a portion embedded in the cable housing 12 of each of the flat power source terminals 80, it is possible to prevent short circuit between the terminals 80 by the supporting portion 18. As well shown in FIG. 13(*b*), especially when the shape of the supporting portions 18 and the shape of the space 38 are matched, it is also possible to make the distance along the surface between the flat power source terminals 80.

More specifically, when there is no supporting portion 18, there is a surface for current to flow between the flat power source terminals 80. However, eliminating such surface by inserting the supporting portions 18 fitted to the shape of the space 38, the surface for current to flow, i.e., the distance along the surface can be made long. The shape of the supporting portions 18 may not have to be perfectly matched to that of the space 38, but can be any as long as it can make the distance along the surface long. For example, there can be some gaps between the supporting portions 18 and the space 38.

Therefore, according to the present invention, there are two effects related to the supporting portions 18. More specifically, one effect is to prevent increase of the size of the connector device by disposing elastic engaging portion 15 between the outer wall and the inner wall of the cable-side connector 10 and the board-side connector 60. The other effect is to more effectively prevent short circuit between the flat power source terminals 80 by disposing supporting portions 18, which are a portion of the cable housing 12, in at least a portion of the space formed between the flat power source terminals 80.

Moreover, according to the configuration of the embodiment, the supporting portions 18 are members to support the elastic engaging portion 15, and at the same time are members that serve to prevent short circuit between the flat power source terminals 80. With those two functions of the supporting portions 18, it is possible to prevent short circuit between the flat power source terminals 80, while preventing increase of the size of the connector device, and to provide a connector device having an engaging structure.

Here, upon releasing the engagement between the cable-side connector 10 and the board-side connector 60, the operating portion 14 just needs to be displaced in the direction "b1" indicated with the arrow in the figure, so as to release the engaged state between the engaging portions 16 and engaging hole 66. As well shown in FIG. 13(*a*), the front end 14*a* of the operating portion 14 protrudes frontward more than the front end 52*a* of the board-side housing 52, so that the above-described releasing operation is easy to perform. Pulling the cable-side connector 10 upward in this state, the cable-side connector 10 can be removed from the board-side connector 60.

Another embodiment, characteristics, and effects of the present invention may be easily recognized from the above detailed description by showing a number of specific embodiments and examples including the most preferred embodiment(s) to actualize the present invention. In addition, the present invention may be configure with other different embodiments, and those numerous details may be modified, altered, or changed in various view point without deviating from the spirit and the scope of the present invention. Therefore, the accompanying drawings and the above description are just a portion of the examples, and are not intended to limit the present invention.

The disclosure of Japanese Patent Applications No. 2016-075172, filed on Apr. 4, 2016, is incorporated in the application by reference.

While the present invention has been explained with reference to the specific embodiments of the present invention, the explanation is illustrative and the present invention is limited only by the appended claims.

What is claimed is:

1. A power source connector device, comprising:

a first connector including a first housing and a plurality of first terminals; and a second connector including a second housing and a plurality of second terminals each for contacting with each of the first terminals, wherein said second housing includes a space for accommodating the first housing when the first connecter is connected to the second connector, said second terminals are situated in the space, said first housing includes an outer wall portion, said second housing includes an inner wall portion facing the outer wall portion when the first connecter is connected to the second connector, said outer wall portion includes a first engaging portion, said inner wall portion includes a second engaging portion for engaging with the first engaging portion so that the first engaging portion is situated in the space between the outer wall portion and the inner wall portion when the first connecter is connected to the second connector, said first housing includes a supporting portion situated between two of the second terminals when the first connecter is connected to the second connector, and said first engaging portion is extended from the supporting portion of the first housing.

2. The power source connector device according to claim 1, wherein said first engaging portion includes an elastic engaging piece capable of deforming elastically, and said elastic engaging piece is situated in the space.

3. The power source connector device according to claim 1, wherein said second terminals are arranged in parallel to each other.

4. The power source connector device according to claim 1, wherein said second terminals are arranged to face each other with the space in between.

5. The power source connector device according to claim 1, wherein said second connector is configured to be mounted on a circuit board.

6. The power source connector device according to claim 1, wherein said first connector is configured to connect to the second connector in a direction perpendicular to a circuit board after the second connector is mounted on the circuit board.

7. The power source connector device according to claim 1, wherein at least one of said first connector and said second connector includes a guiding member for guiding the other of the first connector and the second connector.

8. The power source connector device according to claim 1, wherein said first engaging portion includes an operation portion, and said operation portion protrudes outwardly beyond the second housing.

9. The power source connector device according to claim 1, wherein said first housing further includes an insertion hole, said second housing further includes an upright portion inserted into the insertion hole when the first connecter is connected to the second connector, and said supporting portion is situated between the insertion hole and the first engaging portion.

* * * * *